US006113298A

United States Patent [19]

Miro

[11] Patent Number: 6,113,298

[45] Date of Patent: Sep. 5, 2000

[54] PAPER RING

[76] Inventor: Ruth Julia Miro, 4240-03 Hutchinson River Pkwy., East, Apt. 3C, Bronx, N.Y. 10475

[21] Appl. No.: 09/060,947

[22] Filed: Apr. 15, 1998

[51] Int. Cl.[7] ..... B42F 3/00

[52] U.S. Cl. ..... 402/13; 281/27.2; 281/27.3; 281/28; 402/8; 402/36

[58] Field of Search ..... 281/27.1, 27.2, 281/27.3, 28; 402/8, 12, 13, 20, 36, 72; 24/2, 67 P, 67 R, 67.5, 67.9; 411/517, 521

[56] References Cited

U.S. PATENT DOCUMENTS

| | | | |
|---|---|---|---|
| 703,260 | 6/1902 | Holton | 281/27.2 |
| 735,379 | 8/1903 | Holton | 281/27.2 |
| 808,652 | 1/1906 | Hackmann et al. | 281/27.3 |
| 887,979 | 5/1908 | Stckwell | 24/66 |
| 1,071,548 | 8/1913 | Bowes | 402/20 |
| 1,163,766 | 12/1915 | Morden | 402/20 |
| 1,354,819 | 10/1920 | Fritz | 402/20 |
| 1,407,863 | 2/1922 | Hochenauer, Jr. | 402/20 |
| 1,998,977 | 4/1935 | Bidwell | 402/8 |
| 2,089,018 | 8/1937 | Catini | 129/1 |
| 2,144,581 | 1/1939 | Trussell | 281/27.2 |
| 2,200,146 | 5/1940 | Block | 281/27.2 |
| 2,583,998 | 1/1952 | Cook | 281/27.3 |
| 3,057,028 | 10/1962 | Lorber | 24/66 |
| 4,365,434 | 12/1982 | Doyel | 281/27.2 |
| 4,500,223 | 2/1985 | Downing et al. | 402/20 |
| 4,597,139 | 7/1986 | Lau | 24/546 |
| 4,665,594 | 5/1987 | Wagner | 24/546 |
| 4,674,905 | 6/1987 | Masters et al. | 402/64 |
| 4,832,370 | 5/1989 | Jones | 281/27.2 |
| 4,932,804 | 6/1990 | Richards | 402/20 |
| 5,179,765 | 1/1993 | Sungberg | 24/67.9 |
| 5,709,409 | 1/1998 | Engel | 281/27.3 |

*Primary Examiner*—Andrea L. Pitts
*Assistant Examiner*—Monica Smith
*Attorney, Agent, or Firm*—Michael I. Kroll

[57] ABSTRACT

A paper ring (10) comprising a generally double toroidal shaped flexible loop (12) having abutting ends (14), (16) which can be moved apart to fit within aligned punched holes (18) in a stack of loose-leaf pages (20), so as to temporarily hold the loose-leaf pages (20) together and allow a person to turn the loose-leaf pages (20) fully around, making it easier to grasp and rear information (22) on all of the loose-leaf pages (20).

1 Claim, 5 Drawing Sheets

PAPER RING

BACKGROUND OF THE INVENTION

1. Field of the Invention

The instant invention relates generally to loose-leaf paper retainers and more specifically it relates to a paper ring. The paper ring will fit within aligned punched holes in a stack of loose-leaf pages, when the loose-leaf pages are removed from a loose-leaf binder, so as to temporarily hold the loose-leaf pages together. The paper ring will allow a person to turn the loose-leaf pages fully around, making it easier to grasp and rear information on all of the loose-leaf pages.

2. Description of the Prior Art

Numerous loose-leaf paper retainers have been provided in prior art. For example, U.S. Pat. No. 836,127 to Morden; U.S. Pat. No. 5,423,624 to Richards; U.S. Pat. No. 5,503,486 to Zane and U.S. Pat. No. 5,660,490 to Warrington all are illustrative of such prior art. While these units may be suitable for the particular purpose to which they address, they would not be as suitable for the purposes of the present invention as heretofore described.

MORDEN, LUCENA M.

MEANS FOR RETAINING BOOK RINGS IN POSITION

U.S. Pat. No. 836,127

In a loose-leaf file, the combination with a series of book-rings each having an opening section held elastically between the remaining integral members of the ring, of means operating both to hold the book-rings from turning for maintaining the opening sections in the same relative position, and also to hold the rings adjustably for spacing them at any desired distance apart.

RICHARDS, DONNA E.

HINGED LOOSE-LEAF RETAINER SYSTEM

U.S. Pat. No. 5,423,624

A system for retaining stacks of loose-leaf papers in a file folder providing random access to any one sheet is disclosed. The system includes flexible retainer strips sized to fit through perforated holes in the paper and whose ends are configured to releasably couple to form enclosure rings. The ends are securely engaged by relative twisting and inserting of one into the other. A series of adjustment apertures along the length of the retainer allows the formation of varying sizes of enclosure rings. Loops secured to the file folder receive the retainer strips, thus holding the paper stack to the folder. The loops are positioned proximate an edge of the folder and pivotally mounted with a rotational axis aligned with the edge, so as to rotate from one side of the folder to the other. The front or back side of any sheet in the stack may thus be displayed flat for photocopying or other purpose without removal from the retainer system. The mounting support for the loops may be attached to an existing folder with conventional bendable metal tabs, or may include such bendable tabs and be adhesively or otherwise permanently secured to a folder by the manufacturer or by the user. The mounting support may be of various materials and include separate pivoting loops in a hinge or have loops integral with the support pivoting about one or more "living" hinges.

ZANE, BARRY

NOTEBOOK AND NOTEBOOK COVER ASSEMBLY

U.S. Pat. No. 5,503,486

The improved notebook and notebook cover assembly of the present invention includes a notebook, preferably of a loose-leaf type, and a sub-assembly which includes front and rear notebook covers, an edge binder interconnecting the two covers and foldable back upon itself, and a notebook connector releasably interconnecting the notebook only to the covers. Due to the edge binder the covers are movable between a first position wherein the front cover overlies and protects the notebook, and a second position wherein the front cover is behind and flat against the rear cover, thus fully exposing the notebook and supporting it in a flat position for easy viewing and writing therein. The edge binder can have a longitudinal fold line along the length of the center line of the central portion thereof, or can be divided along that center line into two halves joined together by a hinge, such as a piano hinge or a flexible strip of plastic, cloth, paper or rubber. Openable rings or the like releasably secure the notebook to the covers, either directly thereto or to wings connected to the inner surfaces of the covers. If desired, the edge binder can be integral with the covers. Detents may be present on the covers to releasably hold them together when the front cover is in the second position.

WARRINGTON, GLENN

RING BINDER

U.S. Pat. No. 5,660,490

A ring metal for a ring binder having a pair longitudinally arranged leaves partially surrounded and clasped by a resilient metallic shield and a plurality of openable rings having base ends connected to the leaves, such that relative angular orientation of the leaves corresponds to an open or closed condition of the rings. By shaping and arranging the rings with respect to the leaves, such that the closed condition of the rings corresponds to the relative angular orientation of the leaves being one hundred eighty degrees or less measured on a side of the leaves opposite the rings, results in the rings always being urged to the open condition whether open or closed. At least one of the rings provides a hook formation, to lock ring halves of at least one ring to lock the rings and leaves in the closed orientation.

SUMMARY OF THE INVENTION

A primary object of the present invention is to provide a paper ring that will overcome the shortcomings of the prior art devices.

Another object is to provide a paper ring that will fit within aligned punched holes in a stack of loose-leaf pages, when the loose-leaf pages are removed from a loose-leaf binder, so as to temporarily hold the loose-leaf pages together.

An additional object is to provide a paper ring that will allow a person to turn the loose-leaf pages fully around, making it easier to grasp and rear information on all of the loose-leaf pages.

A further object is to provide a paper ring that is simple and easy to use.

A still further object is to provide a paper ring that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
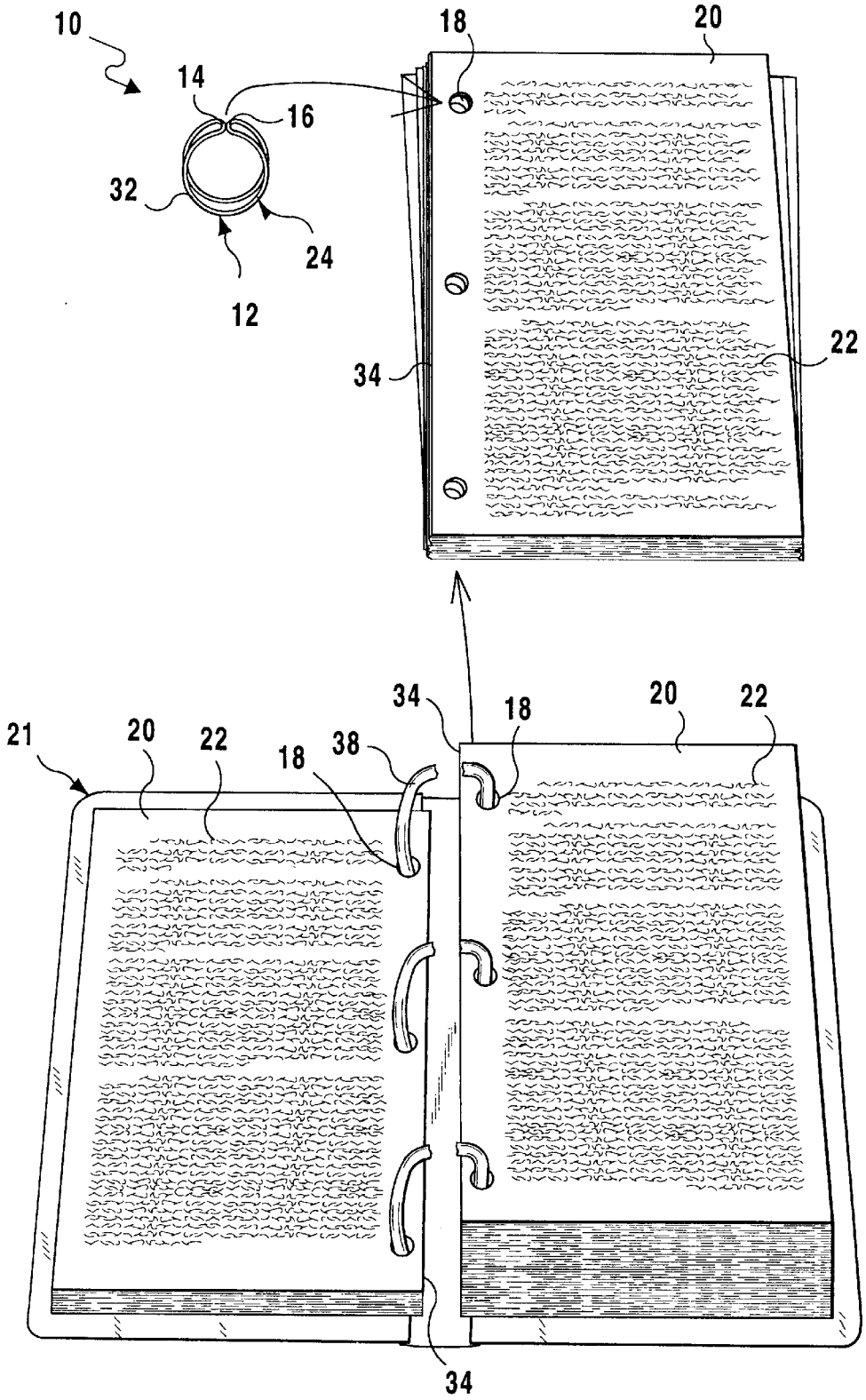
FIG. 1 is a perspective view of a typical opened loose-leaf binder with some of the loose-leaf pages removed, showing the present invention ready to be installed within one of the punched holes of the removed loose-leaf pages.

Turning now descriptively to the drawings, in which similar reference characters denote similar elements throughout the several views, FIGS. 1 through 4 illustrate the present invention being a paper ring. With regard to the reference numerals used, the following numbering is used throughout the various drawing figures.

10 paper ring
12 generally double toroidal shaped flexible loop of 10
14 first abutting end of 12
16 second abutting end of 12
18 punched hole in 20
20 loose-leaf page
21 loose-leaf binder
22 information on 20
23 thin strong pliable wire-like core of 12
24 protective covering of 12
26 lightweight metal material for 22
28 shinning rubber material for 24
30 continuous cylindrical band for 22
32 continuous cylindrical sleeve for 24
34 side edge of 20
36 top edge of 20
38 retainer ring of 21

The paper ring 10 comprises a generally double toroidal shaped flexible loop 12 having abutting ends 14, 16 which can be moved apart to fit within aligned punched holes 18 in a stack of loose-leaf pages 20, so as to temporarily hold the loose-leaf pages 20 together and allow a person to turn the loose-leaf pages 20 fully around, making it easier to grasp and read information 22 on all of the loose-leaf pages 20. The stack of loose-leaf pages 20 can be removed from an opened loose-leaf binder 21, shown in FIG. 1.

The generally double toroidal shaped flexible loop 12 includes a thin strong pliable wire-like core 23. A protective covering 24 is applied over the thin strong pliable wire-like core 22. The thin strong pliable wire-like core 23 is fabricated out of a lightweight metal material 26. The protective covering 24 is fabricated out of a shining rubber material 28 (see FIG. 4).

The thin strong pliable wire-like core 23 is a continuous cylindrical band 30. The protective covering 24 is a continuous cylindrical sleeve 32, sized to fit snugly over the thin strong pliable wire-like core 23.

The generally double toroidal shaped flexible loop 12 can be made in different sizes, so as to be able to fit into the aligned punched holes 18 in various sized stacks of loose-leaf pages 20. The protective covering 24 can be made in different colors, to appeal to the individual preferences of people.

Figure 2:
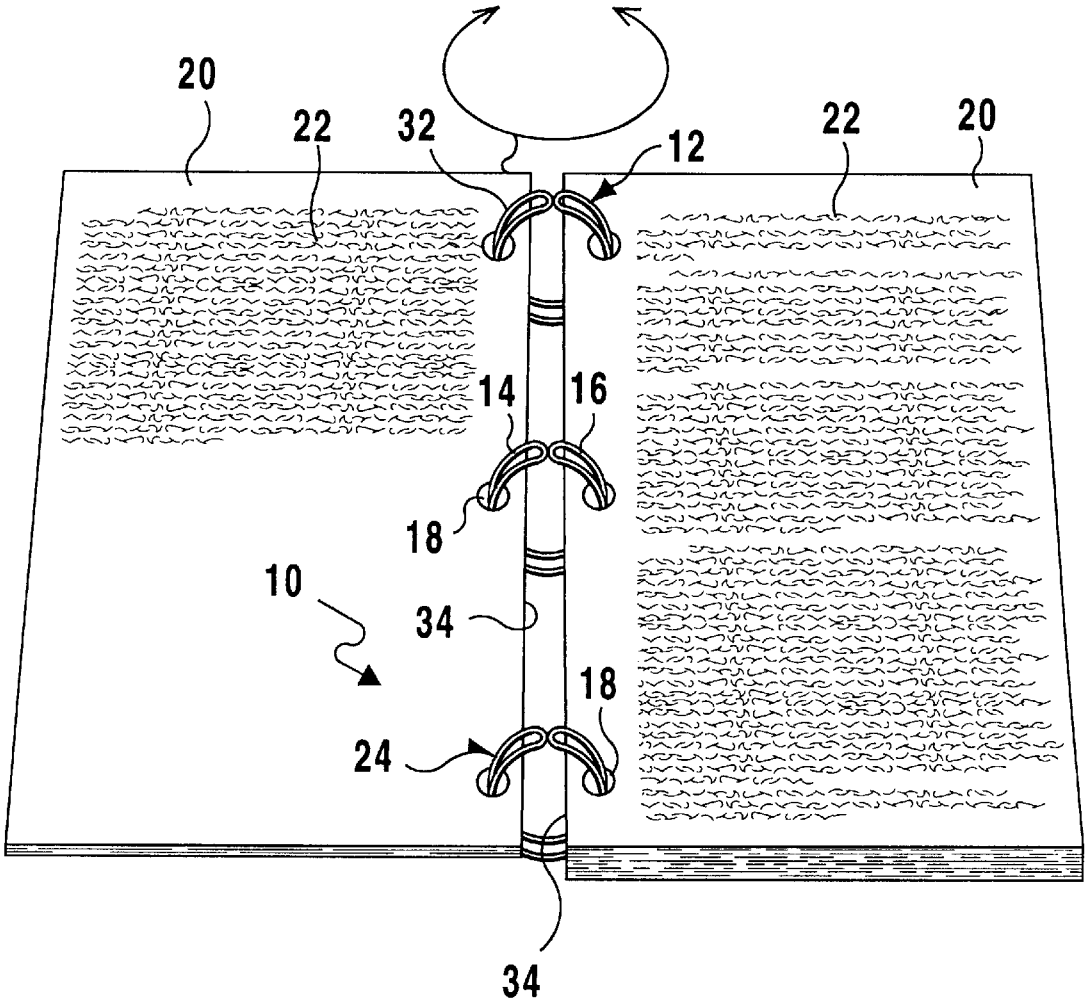
FIG. 2 is a perspective view of the removed loose-leaf pages temporarily held together by three units of the present invention.
Figure 2A:
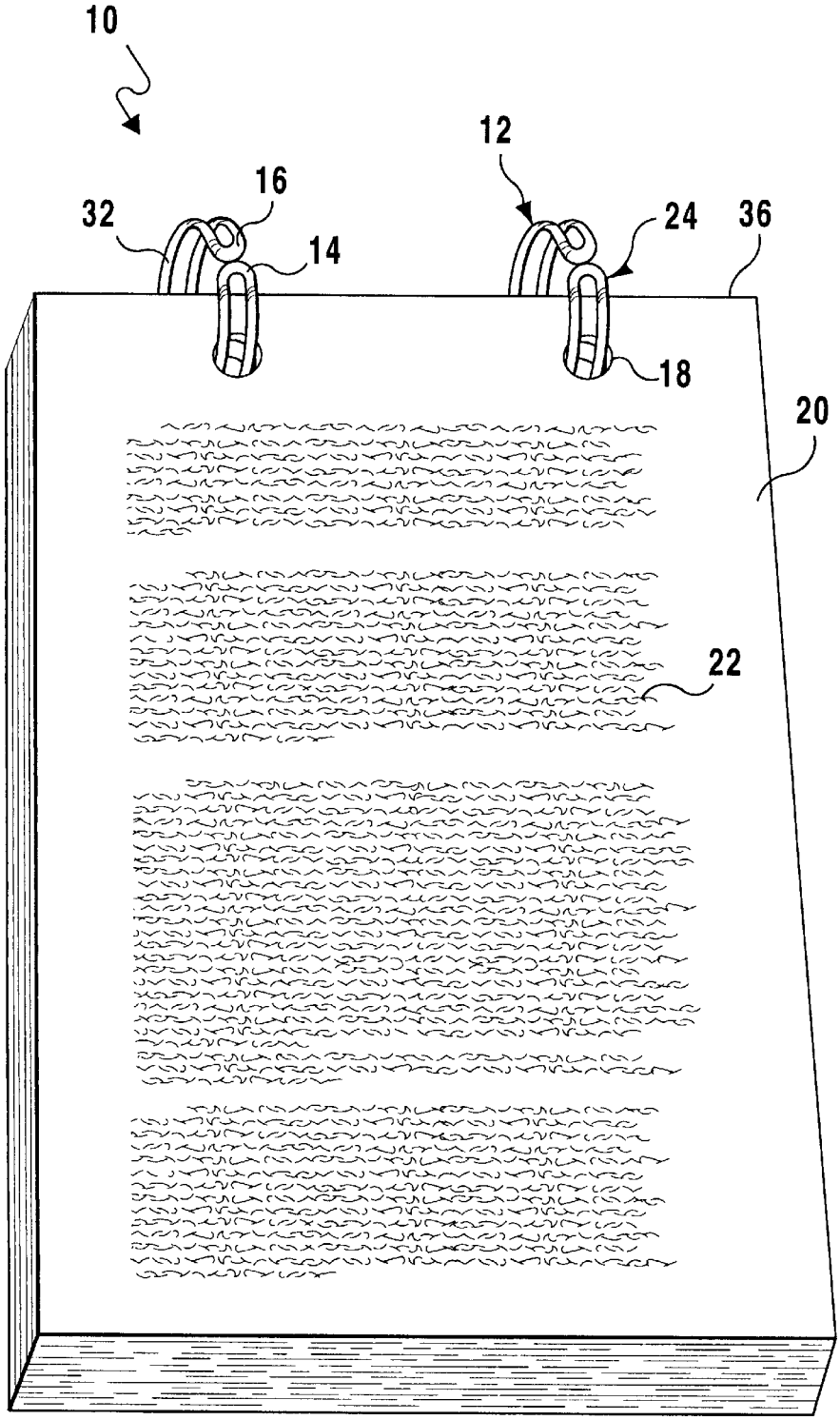
FIG. 2A is a perspective view of a plurality of loose-leaf pages with punched holes along the top edges, temporarily held together by two units of the present invention.
Figure 3:
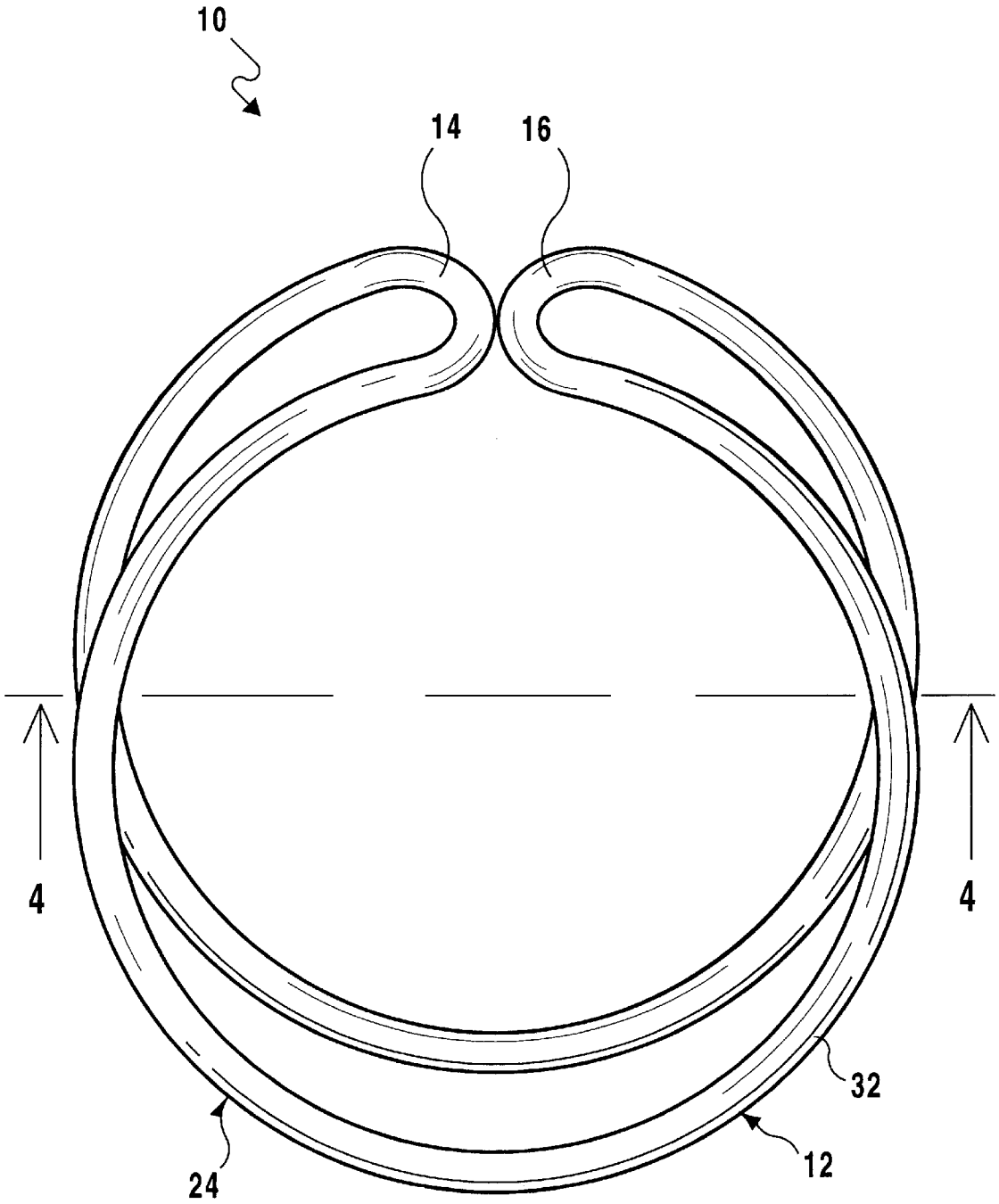
FIG. 3 is an enlarged perspective view of the present invention per se.
Figure 4:
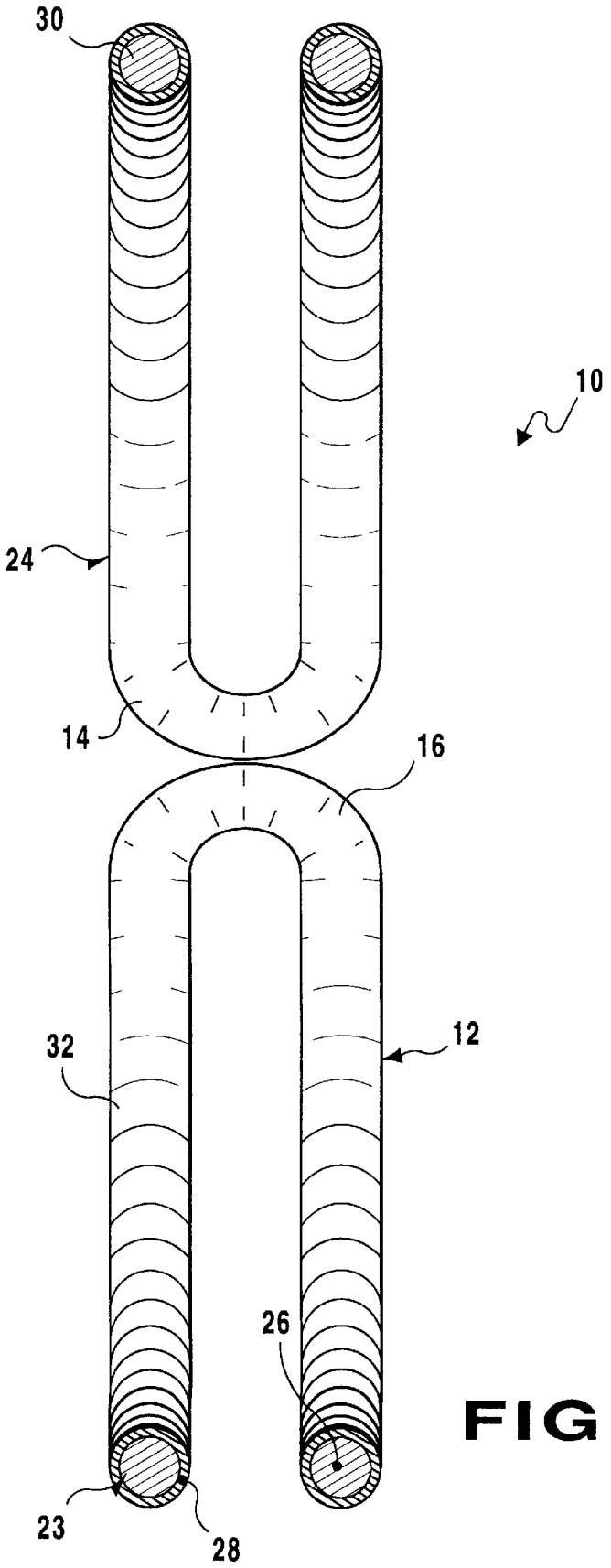
FIG. 4 is a cross sectional view taken along line 4—4 in FIG. 3.

The generally double toroidal shaped flexible loop 12 can be utilized as multiple units, to fit within all of the aligned punched holes 18 in the stack of loose-leaf pages pages 20. The multiple units of the generally double toroidal shaped flexible loop 12 can fit within all of the aligned punched holes 18 in the stack of loose-leaf pages 20 located adjacent side edges 34 thereof, as shown in FIGS. 1 and 2. The multiple units of the generally double toroidal shaped flexible loop 12 can also fit within all of the aligned punched holes 18 in the stack of loose-leaf pages 20 located adjacent top edges 36 thereof, as shown in FIG. 2A.

OPERATION OF THE INVENTION

To use the paper ring 10, the following steps should be taken:

1. Open the loose-leaf binder 21.
2. Open the retainer rings 38 of the loose-leaf binder 21.
3. Remove the stack of loose-leaf pages 20 from the opened retainer rings 38 of the opened loose-leaf binder 21.
4. Spread apart the abutting ends 14 and 16 of the generally double toroidal shaped flexible loop 12 of the paper ring 10.
5. Insert one of the ends 14 or 16 into the aligned punched holes 18 in the stack of loose-leaf pages 20, to temporarily hold the loose-leaf pages together, as shown in FIG. 1.
6. Repeat steps 4 and 5, if additional paper rings 10 are to be placed through the other aligned punched holes 18 in the stack of loose-leaf pages 20, as shown in FIG. 2.
7. Turn the loose-leaf pages 20 fully around, making it easier to grasp and read the information 22 on all of the loose-leaf pages 20.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A paper ring comprising:

a) a double toroidal shaped flexible closed loop formed by an endless continuous member having abutting looped ends which are movable apart to fit within aligned punched holes in a stack of loose-leaf pages, so as to temporarily hold the loose-leaf pages together and allow a person to turn the loose-leaf pages fully around, making it easier to grasp and read information on all of the loose-leaf pages;

b) said double toroidal shaped flexible loop including a thin strong pliable wire-like core and a protective covering applied over said thin strong pliable wire-like core; and c) adjacent toroidal portions of the member being substantially uniformly spaced apart over their whole lengths.

* * * * *